US012421959B1

(12) United States Patent
Jefferies

(10) Patent No.: US 12,421,959 B1
(45) Date of Patent: Sep. 23, 2025

(54) PAD PLUNGER

(71) Applicant: James Allen Jefferies, Granbury, TX (US)

(72) Inventor: James Allen Jefferies, Granbury, TX (US)

( * ) Notice: Subject to any disclaimer, the term of this patent is extended or adjusted under 35 U.S.C. 154(b) by 0 days.

(21) Appl. No.: 18/425,364

(22) Filed: Jan. 29, 2024

(51) Int. Cl.
*F04B 53/14* (2006.01)
*F04B 47/12* (2006.01)

(52) U.S. Cl.
CPC ..... *F04B 53/14* (2013.01); *F04B 47/12* (2013.01)

(58) Field of Classification Search
CPC ..... E21B 43/121; F04B 53/14; F04B 47/12
See application file for complete search history.

(56) References Cited

U.S. PATENT DOCUMENTS 4,531,891 A * 7/1985 Coles, III ..... F04B 47/02 417/59
5,427,504 A * 6/1995 Dinning ..... F04B 47/12 417/59
6,746,213 B2 * 6/2004 Giacomino ..... E21B 43/121 417/56
7,117,947 B2 * 10/2006 Wilson ..... E21B 43/121 166/372
7,314,080 B2 * 1/2008 Giacomino ..... E21B 43/121 417/56
7,451,823 B2 * 11/2008 Wilson ..... E21B 43/121 166/372
7,513,301 B2 * 4/2009 Victor ..... E21B 43/121 166/105
7,523,783 B2 * 4/2009 Victor ..... E21B 17/1071 166/105
8,162,053 B2 * 4/2012 Green ..... E21B 43/121 166/241.7
8,869,902 B2 * 10/2014 Smith ..... F04B 47/12 166/69
9,121,269 B2 * 9/2015 Longfellow ..... E21B 43/121
9,915,133 B2 * 3/2018 Boyd ..... E21B 43/121
9,932,805 B2 * 4/2018 Kuykendall ..... E21B 43/13
9,976,413 B2 * 5/2018 Cramer ..... E21B 47/12
10,100,826 B2 * 10/2018 Casey ..... F04B 47/12
10,577,903 B2 * 3/2020 Green ..... E21B 43/121
11,441,400 B2 * 9/2022 Blood ..... E21B 34/08
11,732,558 B2 * 8/2023 Boyd ..... E21B 43/121 166/243
2009/0272519 A1 * 11/2009 Green ..... F04B 47/12 166/66

* cited by examiner

*Primary Examiner* — Aaron L Lembo
(74) *Attorney, Agent, or Firm* — James E. Walton

(57) ABSTRACT

A pad plunger for lifting fluids in a well with a central mandrel attached to a top cap, a bottom cap, at least one capture ring, at least one canted coil spring, and at least one set of pads. The central mandrel is also comprised of at least one set of spring grooves, at least one pad groove disposed between the spring grooves, a central support ring, at least one outer support ring on the end of the central mandrel, and at least one series of outer threads beyond the outer support ring.

15 Claims, 7 Drawing Sheets

PAD PLUNGER

BACKGROUND

1. Field of the Invention

The present application generally relates to oil and gas production operations, and more particularly, to pad plunger devices for restoring production to wells by lifting production fluids to the surface.

2. Description of Related Art

Presently, pad plunger devices have been in use for many decades and have a long history of development. The goal of these devices is to restore production in wells by using the fluid pressure in the well to lift the production fluids to the surface. To restore production to a well, first the plunger must be able to reach the bottom of the well to successfully build up pressure. Once the plunger reaches the desired location in the well, the plunger will block the well creating a seal, thereby allowing the fluid pressure to build up below the plunger. The pressure will eventually become strong enough to break this seal and lift the fluids and the plunger to the surface. Multiple variations have been made over the years to increase productivity of these systems. One focus has been on using pads to increase the diameter of the plunger to create a better seal within the well. Another focus has been on using springs to adjust the diameter of these pads during the descent into the well to accommodate for any blockage which might be present in the well.

While multiple improvements have been made throughout the years to improve these systems, not all of them are cost effective or are long lasting, and many shortcomings remain.

DESCRIPTION OF THE DRAWINGS

The novel features believed characteristic of the application are set forth in the appended claims. However, the application itself, as well as a preferred mode of use, and further objectives and advantages thereof, will best be understood by reference to the following detailed description when read in conjunction with the accompanying drawings, wherein:

Figure 1:
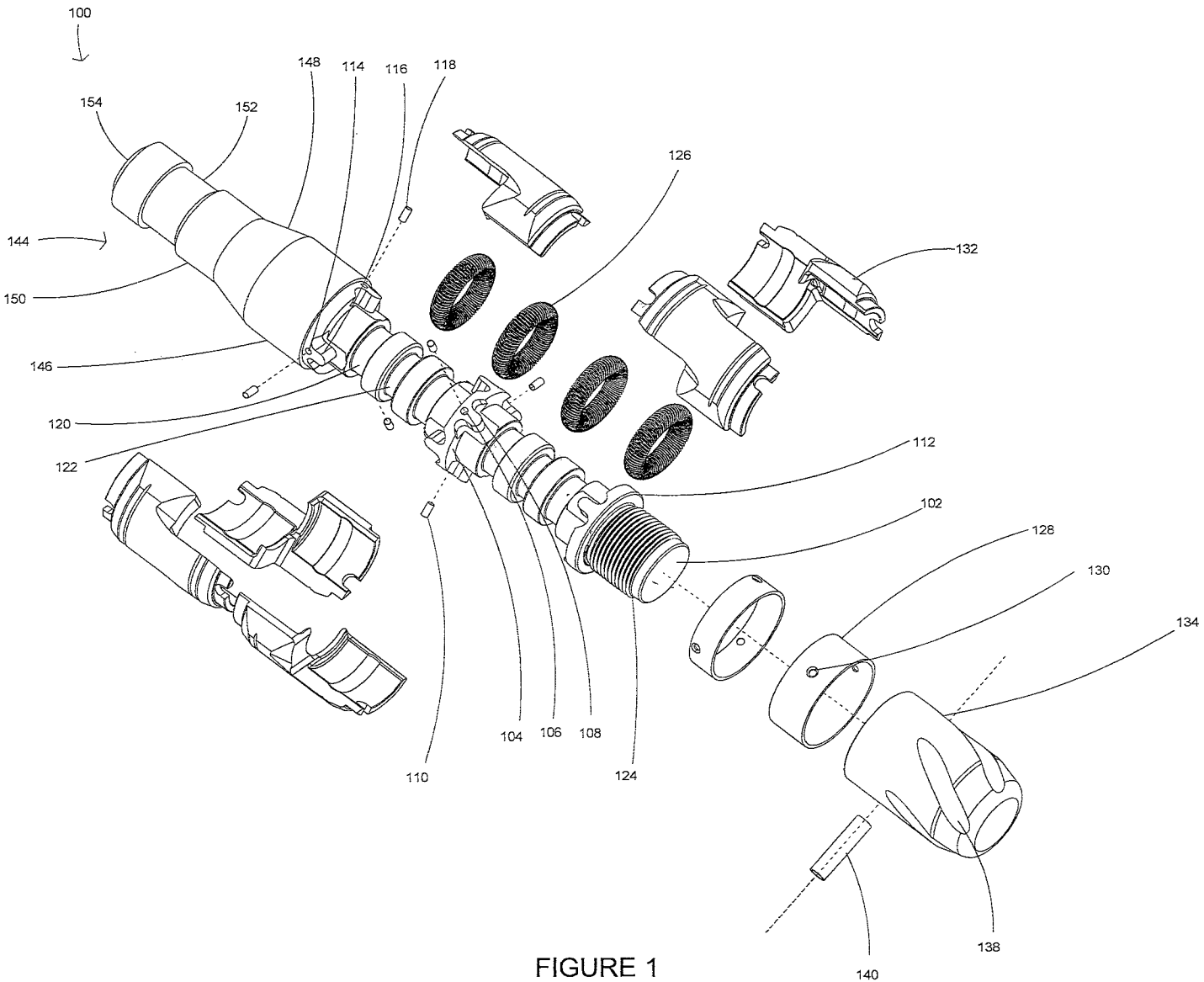
FIG. 1 is a perspective exploded view of a pad plunger according to a preferred embodiment of the present application.

While the method and device of the present application are susceptible to various modifications and alternative forms, specific embodiments thereof have been shown by way of example in the drawings and are herein described in detail. It should be understood, however, that the description herein of specific embodiments is not intended to limit the invention to the particular embodiment disclosed, but on the contrary, the intention is to cover all modifications, equivalents, and alternatives falling within the spirit and scope of the present application as defined by the appended claims.

DETAILED DESCRIPTION OF THE PREFERRED EMBODIMENT

Illustrative embodiments of a pad plunger according to the present application are provided below. It will of course be appreciated that in the development of any actual embodiment, numerous implementation-specific decisions will be made to achieve the developer's specific goals, such as compliance with assembly-related and business-related constraints, which will vary from one implementation to another. Moreover, it will be appreciated that such a development effort might be complex and time-consuming but would nevertheless be a routine undertaking for those of ordinary skill in the art having the benefit of this disclosure. It is also appreciated that the use of "a" or "an" before a noun naming an object is construed to be that the noun refers to both the singular and the plural.

Referring now to FIG. 1 in the drawings, an exploded view of pad plunger 100 according to the preferred embodiment of the present application is illustrated. Plunger 100 is generally comprised of a central mandrel 102, a central support ring 104, central pin slot 106, central ring protrusions 108, central pin 110, outer support rings 112, outer pin slot 114, outer ring protrusions 116, outer pin 118, canted coil spring grooves 120, pad grooves 122, outer threads 124, canted coil springs 126, steel capture rings 128, steel capture ring pin slot 130, pad assembly 132, a bottom cap 134, bottom cap pin slot 136, bottom cap grooves 138, bottom cap pin 140, bottom cap inner threads 142, a top cap 144, top cap base 146, top cap slanted surface 148, retrieval neck 150, retrieval groove 152, and retrieval head 154. When pad plunger 100 is inserted into a well, plunger 100 will be oriented vertically with bottom cap 134 being the first section of pad plunger 100 to be inserted into the well. The bottom half of bottom cap 134 has a hollow base with inner threads 142 which can be threaded onto outer threads 124 found on at least one outer end of central mandrel 102 to secure bottom cap 134 to central mandrel 102. Bottom cap 134 further has bottom cap grooves 138 which are helically shaped and run from the top of bottom cap 134 to the middle of bottom cap 134. Bottom cap grooves 138 will alter the flow of fluid around pad plunger 100 causing pad plunger 100 to spin while descending into the well. By spinning, pad plungers 100 rate of descent will increase allowing pad plunger 100 to reach the bottom of the well at a faster rate. Since central mandrel 102 does not have a bore to allow fluid to flow through, fluid will be pushed down the well by pad plunger 100 during pad plunger's 100 descent which slows the rate at which pad plunger 100 descends. By adding grooves 138, pad plunger 100 will reach the bottom of the well sooner than plunger 100 would without grooves 138.

Central mandrel 102 and pad assembly 132 are preferably made of type 4140 heat treated steel or similar material. The remaining components, including top cap 144, bottom cap 134, and steel capture rings 128 are also preferably made of 4140 heat treated alloy steel. While particular types of steel are stated in this application, it will be appreciated that the various components of plunger 100 may be fabricated from any similar type of heat treated steel or similar material. These materials are readily available as solid "rounds" in a variety of diameters, as is well known in the art.

Figure 2:
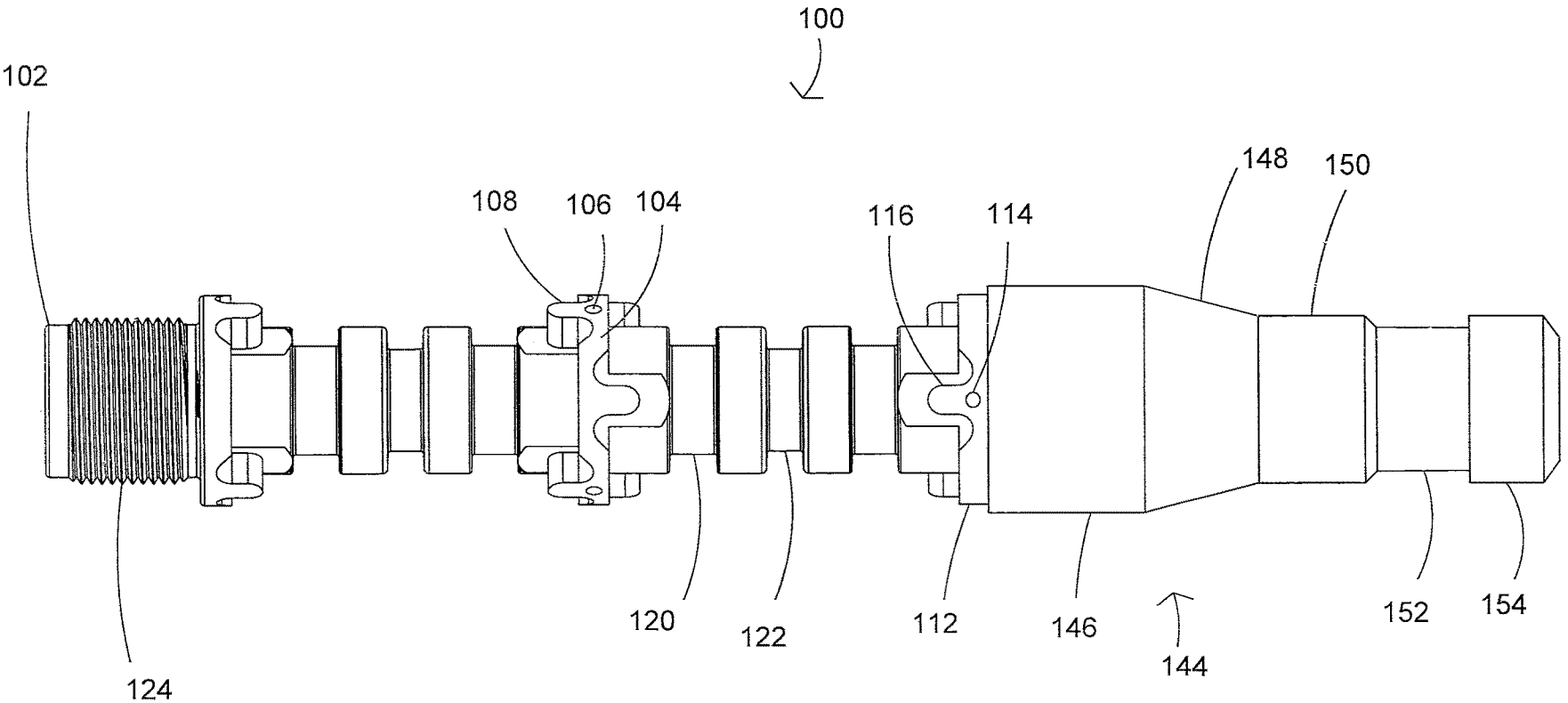
FIG. 2 is a perspective view of the pad plunger from FIG. 1 without the pads and back cap.
Figure 3B:
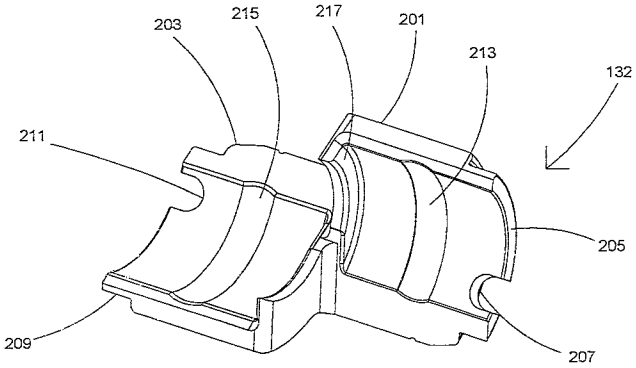
FIG. 3B is a perspective view of one of the pads from the pad plunger from FIG. 3A.
Figure 3D:
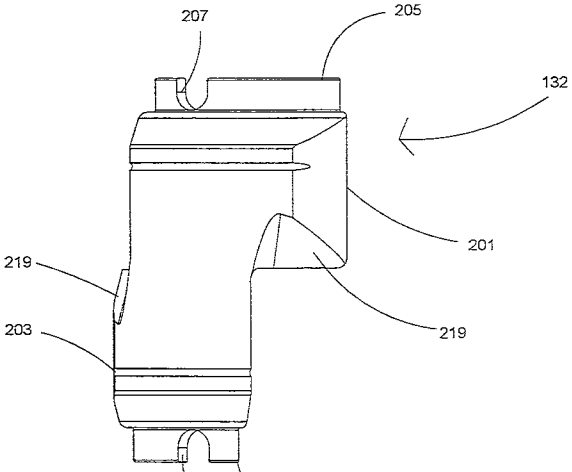
FIG. 3D is a side view of one of the pads from the pad plunger from FIG. 4A.
Figure 3A:
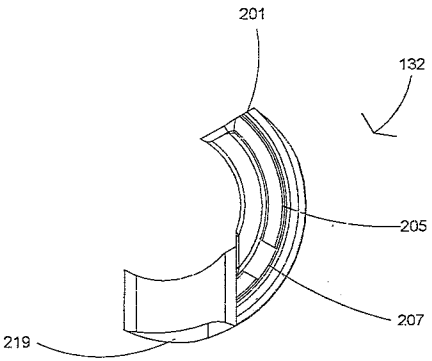
FIG. 3A is a top view of one of the pads from the pad plunger from FIG. 1.
Figure 3C:
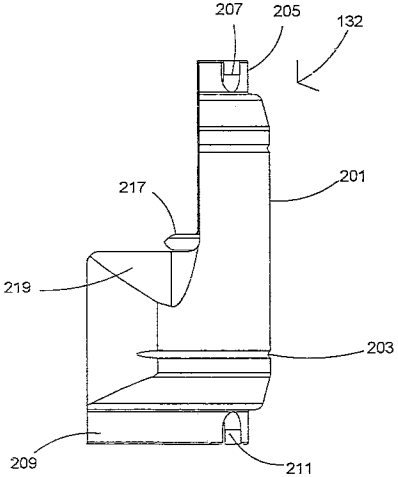
FIG. 3C is a side view of one of the pads from the pad plunger from FIG. 4A.

Referring now also to FIG. 2 in the drawings, central mandrel 102 of pad plunger 100 from FIG. 1 is depicted. FIG. 2 provides a view of central mandrel 102 without canted coil springs 126, steel capture rings 128, pad assembly 132, or bottom cap 134 being depicted. In the current embodiment shown in FIG. 2, top cap 144 is a solid section of material integrally connected with central mandrel 102 instead of being secured by outer threads 124 like bottom cap 134. However, alternative embodiments may also exist where top cap 144 is not integrally connected to central mandrel 102 and instead is connected to central mandrel 102 using outer threads 124. In this alternative embodiment, central mandrel 102 will have outer threads 124 on each end, unlike in the present embodiment where there are only outer threads 124 on the end opposite of top cap 144.

Top cap 144 is generally comprised of top cap base 146, top cap slanted surface 148, retrieval neck 150, retrieval groove 152, and retrieval head 154. In the current embodiment, top cap 144 is a solid piece of material integrally connected to the top of central mandrel 102. However, alternative embodiments may also exist where top cap base 146 is hollow with inner threads to allow top cap base 146 to connect to outer threads 124 to secure top cap 144 to central mandrel 102. Top cap base 146 also has a larger radius than central mandrel 102 which creates one side of a groove for capture rings 128 which is formed when the pads of pad assembly 132 are placed on central mandrel 102. On the other end of top cap base 146 is slanted surface 148 which decreases the radius of top cap 144 until reaching retrieval neck 150. At the top end of top cap 144 there is retrieval head 154 with the same radius as retrieval neck 150 which is connected to retrieval neck 150 by retrieval groove 152. Retrieval groove 152 has a slightly smaller radius than both retrieval neck 150 and retrieval head 154 to create a grooved space. Retrieval groove 152 along with retrieval head 154 provide a way for operators to retrieve pad plunger 100 by using a wire or other device to hook onto the ledge created by retrieval groove 152 underneath retrieval head 154 and pull plunger 100 out of the well.

Central mandrel 102 further has a series of grooves where canted coil springs 126 and pads 132 are inserted. Central mandrel 102 has a set of two canted coil spring grooves. 120 on either end with the sets of spring grooves 120 being separated by central support ring 104. Spring grooves 120 run the entire circumference of central mandrel 102 and are wide enough such that canted coil spring 126 is secured in place once inserted. Between each set of spring grooves 120 is a pad groove 122 which will receive central ridge 217 of pads 132.

Located at a selected location along the length of central mandrel 102 there is central support ring 104 and central ring protrusions which run the circumference of central mandrel 102. In the preferred embodiment, central support ring 104 is disposed at the longitudinal center of central mandrel 102. Central protrusions 108 alternate between extending in the direction of top cap 144 and extending in the direction of where bottom cap 134 will be secured to outer threads 124. Also located along the length of central mandrel 102 there are outer support rings 112 and outer ring protrusions 116 preferably at the outer longitudinal ends of central mandrel 102. Outer ring protrusions 116 are aligned with central ring protrusions 108 and project towards central ring 104 when central ring protrusions 108 are protruding towards outer ring 112. Central support ring 104 further has central pin slot 106 where protrusions are extended from ring 104 which are where central pins 110 will be inserted through steel capture ring 128 to secure ring 128 to central support ring 104. Outer support rings 112 also have outer pin slots 114 in the same orientation as central pin slots 106 and outer pins 118 to secure steel capture rings 128 to outer support rings 112.

Referring now also to FIGS. 3A-3D in the drawings, a close-up view of pads which comprise pad assembly 132 from FIG. 1 are depicted. FIGS. 3A-3D show that pads 132 are generally comprised of an upper portion 201, a lower portion 203, an upper protrusion 205, an upper protrusion slot 207, a lower protrusion 209, a lower protrusion slot 211, an upper spring groove 213, a lower spring groove 215, a central ridge 217, and slanted grooves 219. Pads 132 are generally constructed out of a singular continuous piece of material but can be referred to as having an upper portion 201 and a lower portion 203. Between the upper portion 201 and lower portion 203 of pads 132 is central ridge 217 which acts as the base of upper portion 201 and the top of lower portion 203. Upper portion 201 is also off center from lower portion 203 such that upper portion 201 has an overhang portion without anything beneath upper portion 201 while lower portion 203 has a section where there is nothing above the top of lower portion 203. Both the overhang portion of upper portion 201 and the section of lower portion 203 with nothing above have slanted grooves 219 going into upper portion 201 and lower portion 203. Slanted grooves 219 provide a place for other pads 132 to move relative to each other when pads 132 are placed onto central mandrel 102.

Upper portion 201 also has an upper protrusion 205 which is a section of material extending the full curved length of upper portion 201. On the section of upper protrusion 205 above both upper portion 201 and lower portion 203, upper protrusion 205 further has circular upper protrusion slot 207 running the height of upper protrusion 205. Lower portion 203 also has lower protrusion 209 and lower protrusion slot 211 which functions and is oriented the same as upper protrusion 205 and upper protrusion slot 207. Also, lower protrusion slot 211 is located bellow where upper protrusion slot 207 is located on pad 132. Upper protrusion slot 207 and lower protrusion slot 211 are used to connect pads 132 to central protrusions 108 and outer protrusions 116 found on central mandrel 102.

On the inside of upper portion 201 there is upper spring groove 213 and the inside of lower portion 203 has lower spring groove 215. When pads 132 are placed onto central mandrel 102, pads 132 will be placed over springs 126. When pads 132 are placed onto central mandrel 102, springs 126 will fit into upper groove 213 and lower groove 215 so that pads 132 can be placed onto central mandrel 102 without compressing springs 126. When pads 132 are placed onto central mandrel 102, central ridge 217 will fit into pad grooves 122 so that pads 132 can get as close to central mandrel 102 as possible to decrease the radius of plunger 100 if needed.

Figure 4B:
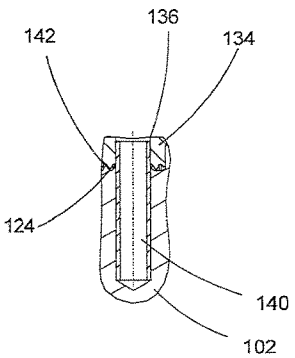
FIG. 4B is an enlarged detailed view of a section of the pad plunger from FIG. 4A.
Figure 4A:
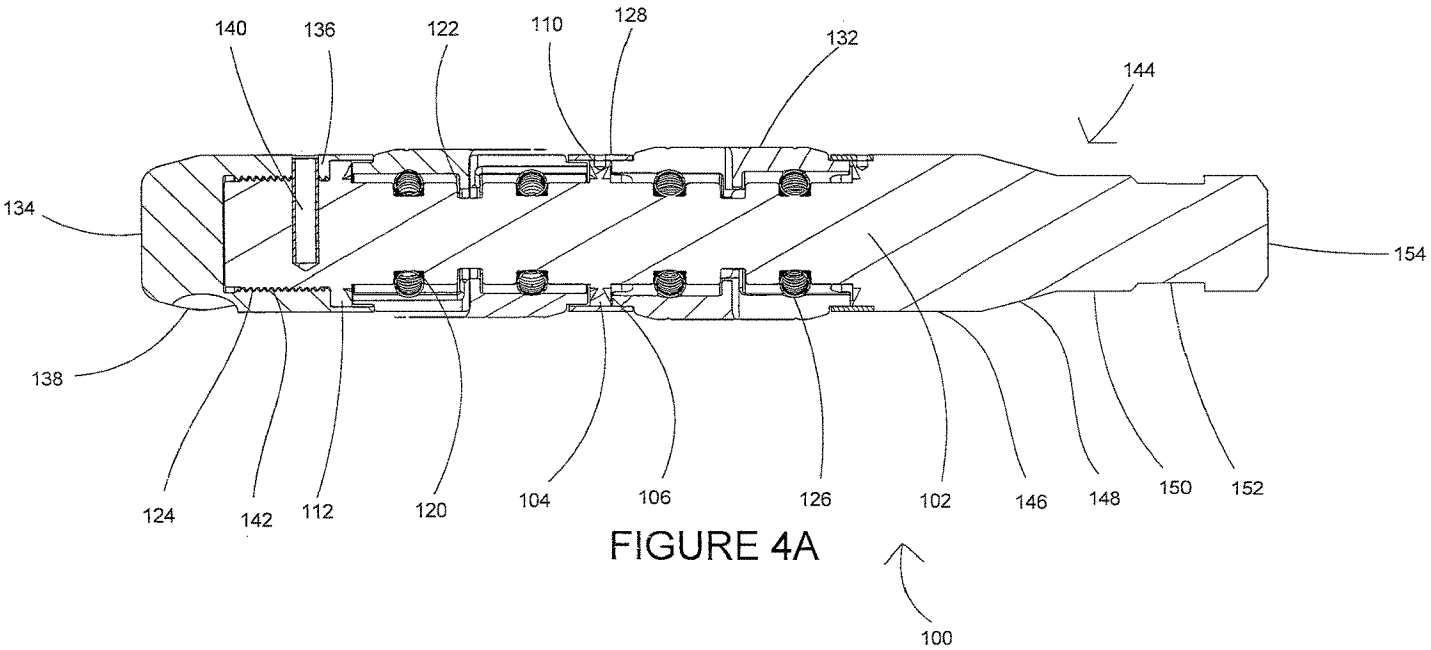
FIG. 4A is a side cross-sectional view of the pad plunger from FIG. 1.
Figure 5B:
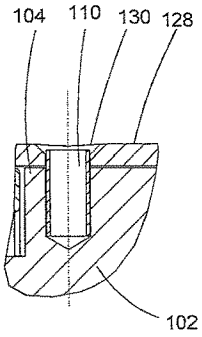
FIG. 5B is an enlarged detailed view of a section of the pad plunger from FIG. 5A.
Figure 5A:
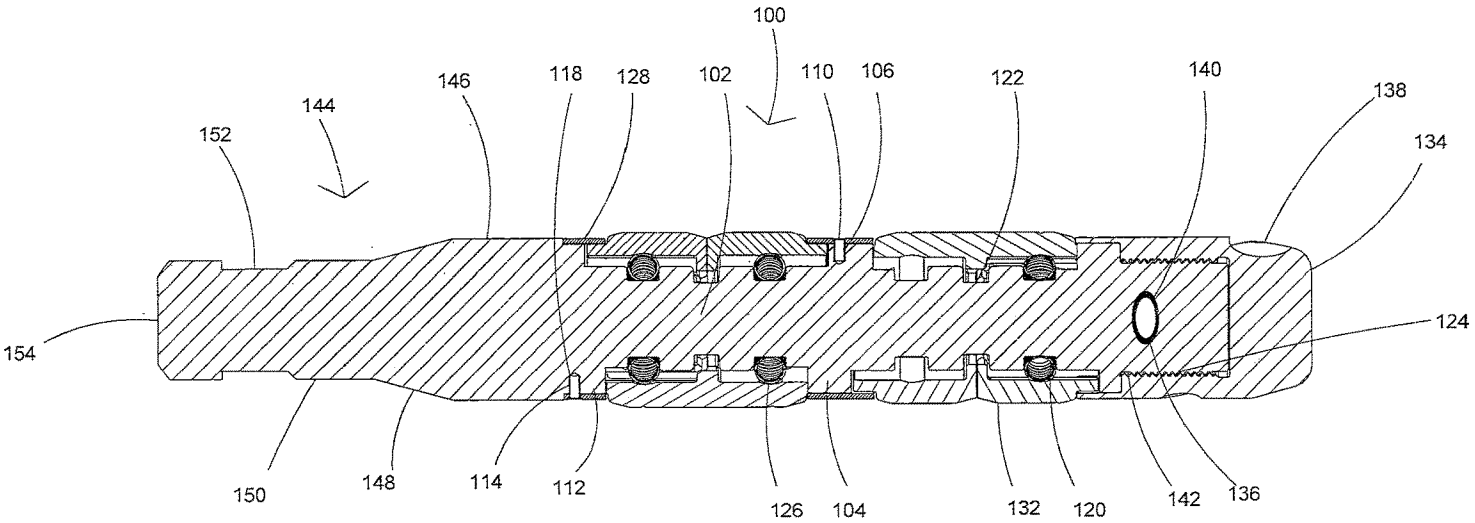
FIG. 5A is a side cross-sectional view of the pad plunger from FIG. 1.

Referring now also to FIGS. 4A-5B in the drawings, cross-sectional views of pad plunger 100 from FIG. 1 fully assembled are depicted. FIG. 4A and FIG. 5A provide views of the inside of pad plunger 100 when pads 132, capture rings 128, and bottom cap 134 are placed onto central mandrel 102. These figures also provide a view of bottom cap pin slot 136 and bottom cap pin 140 which are used to secure bottom cap 134 onto central mandrel 102 after bottom cap 134 has been threaded onto central mandrel 102. FIG. 4B further shows a detailed view of bottom cap pin 140 after pin 140 has been inserted through bottom cap 134 and central mandrel 102. FIG. 5B further shows a detailed view of central pin 110 after pin 110 has been inserted through capture ring 128 into central pin slot 106 found in central support ring 104.

Figure 6:
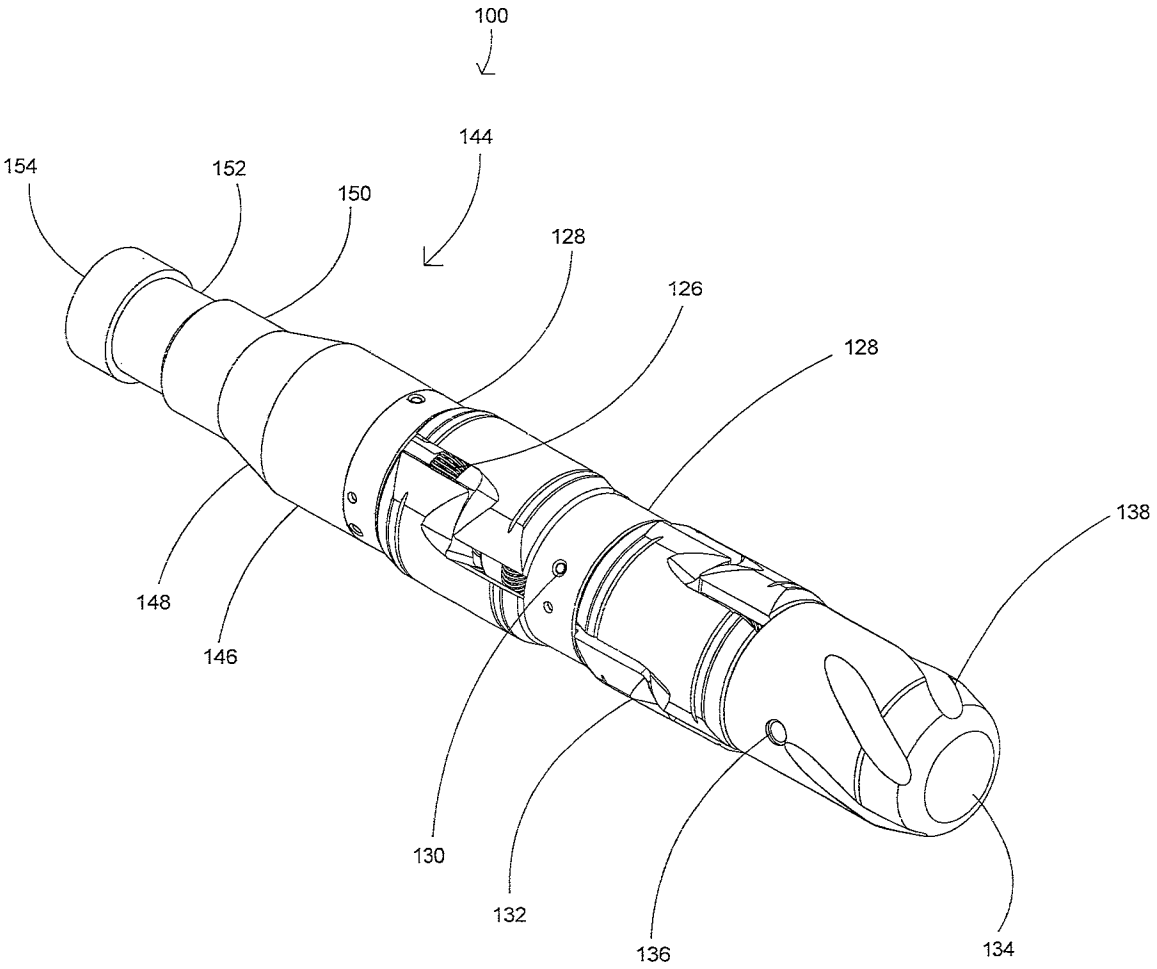
FIG. 6 is a perspective view of the pad plunger from FIG. 1.

Referring now also to FIG. 6 in the drawings, a view of pad plunger 100 according to the preferred embodiment in FIG. 1 is depicted. FIG. 4 depicts plunger 100 when every piece has been installed and pad plunger 100 is ready to be inserted into a well. When preparing pad plunger 100 to be inserted into a well, first canted coil springs will be placed into spring grooves 120 before pads 132 are added. Pads 132 are separated into two sets of three pads 132 with one set on each side of central support ring 104. When inserting pad 132 onto central mandrel 102, pad 132 will be positioned such that central protrusions 108 will fit into lower protrusion slot 211 and outer protrusions 116 will fit into upper protrusion slot 207. Once the first pad 132 has been inserted onto central mandrel 102, the second pad 132 will be inserted such that the overhanging portion of upper portion 201 of one pad 132 will be directly over the section of the lower portion 203 with no upper portion 201 of another pad 132. This process will be repeated with the third, and final, pad 132 so that the ring of pads 132 is completed. Once the ring of pads 132 is formed, slanted grooves 219 will provide leeway for pads 132 to move relative to each other as springs 126 are compressed and expanded to change the radius of plunger 100. Altering the radius of plunger 100 is desirable to allow plunger 100 to compress to maneuver around blockage in a well and also expand to create the necessary seal. Grooves 219 facilitate the movement of pads 132 as springs are expanding to accomplish this desired feature. This will also distribute the pressure of the load placed on springs 126 during compression and expansion to the entire system of pads 132 as they are interconnected and can move to alleviate this pressure.

Once pads 132 are placed onto central mandrel 102, steel capture ring 128 will be placed over central support ring 104 locking that section of pads 132 down. Steel capture rings 128 have three pin slots 130 equal distance from each other along the circumference of ring 128. When rings 128 are placed onto central mandrel 102, steel capture ring pin slots 130 will be aligned over either central pin slots 106 or outer pin slots 114 and secured in place wither either central pins 110 or outer pins 118. In the present embodiment, another ring 128 is also used to secure pads 132 at outer support ring 112 connected to top cap 144. It is not necessary to have another ring 128 located at outer support ring 112 near bottom cap 134 as bottom cap 134 extends over support ring 112 when fastened onto outer threads 124 to secure pads 132 in place. In the alternative embodiment where top cap 144 is also fastened to outer threads 124 to connect to central mandrel 102, there will not be another capture steel ring 128 beyond the central steel ring 128 as top cap 144 will also extend over outer support ring 112 to secure pads 132 in place.

Figure 7:
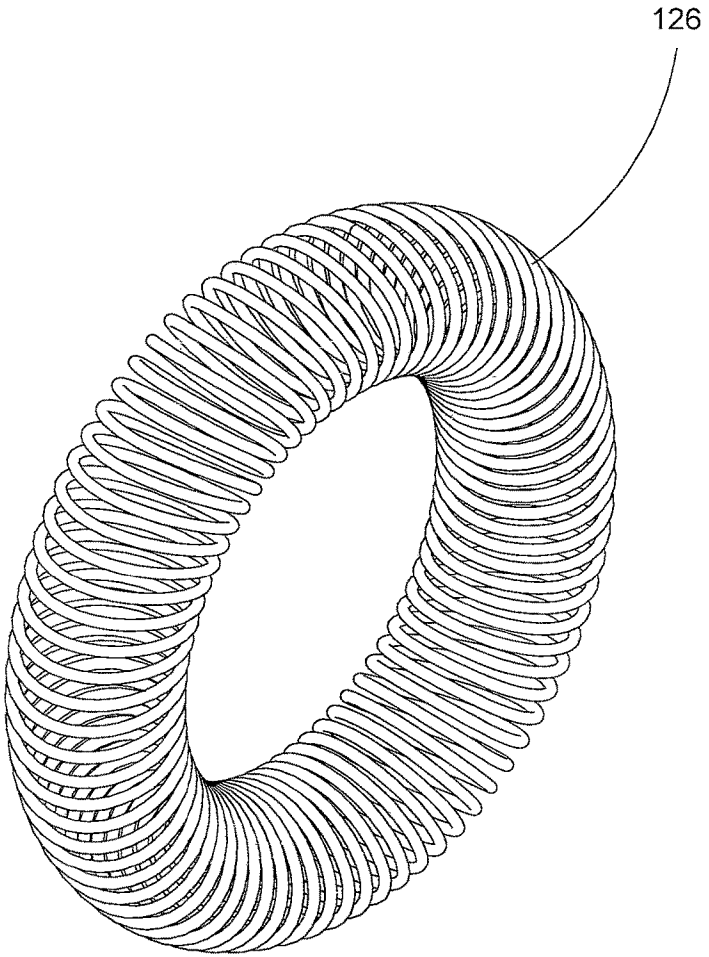
FIG. 7 is a perspective view of one of the canted coil springs from the pad plunger from FIG. 1.

Referring now also to FIG. 7 in the drawings, canted coil spring 126 is illustrated. Canted coil spring 126 is a special coiled spring connected end-to-end in the shape of a circle. When pad plunger 100 is inserted into a well, canted coil spring 126 will be halfway compressed from the pressure of the well which will cause canted coil spring 126 to exert a near constant radially outward force against pads 132. This force is not decreased even if exposed to high temperatures. This outward force on pads 132 prevents pads 132 from compressing and breaking the seal created by pad plunger 100, unless the outward force created by springs 126 is exceeded, such as by force created when plunger 100 encounters protrusions on the side of the well wall, which will compress spring 126 while that force is present. Once that pressure is no longer present however, spring 126 will revert back to being half compressed.

The large number of coils which create canted coil spring 126 compensate for any misalignment or irregularities in canted coil spring 126 from continued use. Because the large number of coils in canted coil spring 126 compensate for irregularities in the structure of canted coil spring 126, canted coil spring 126 will have an increased durability which increases how long spring 126 can be used without replacement. Canted coil spring 126 is preferably made from type 302 stainless steel but may be made with any type of heat resistant material, such as stainless steel, zirconium copper, or beryllium copper. Canted coil spring 126 may be otherwise treated with conventional methods and materials for improved resistance to corrosive materials, further extending the life of canted coil spring 126. It is further appreciated that while canted coil springs 126 are used in the present application, alternative embodiments can exist where coiled springs which are not canted are used instead of canted coil springs 126.

It is apparent that a system with significant advantages has been described and illustrated. The particular embodiments disclosed above are illustrative only, as the embodiments may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description. Although the present embodiments are shown above, they are not limited to just these embodiments, but are amenable to various changes and modifications without departing from the spirit thereof.

What is claimed is:

1. A pad plunger, comprising:

a central mandrel comprising:

at least one spring groove;

at least one pad groove;

a central support ring disposed at a selected location along a length of the central mandrel; and at least one outer support ring located along the length of the central mandrel;

a top cap disposed at one end of the central mandrel;

a bottom cap disposed at an opposing end of the central mandrel;

at least one canted coil spring disposed at least partially within the at least one spring groove;

at least one pad assembly disposed at least partially within that at least one pad groove; and at least one capture ring configured to retain the corresponding pad assembly.

2. The pad plunger of claim 1, wherein the central mandrel further comprises:

a second spring groove disposed longitudinally to the first spring groove.

3. The pad plunger of claim 2, wherein the pad groove is disposed between the first spring groove and the second spring groove.

4. The pad plunger of claim 1, wherein the at least one spring groove is an annular groove.

5. The pad plunger of claim 1, wherein the at least one pad groove is an annular groove.

6. The pad plunger of claim 1, wherein the central support ring comprises:

a series of protrusions alternating between protruding towards each end of the central mandrel.

7. The pad plunger of claim 6, wherein the outer support ring comprises:

a series of protrusions which protrude towards the central support ring when the central ring protrusion protrudes towards the outer support ring.

8. The pad plunger of claim 1, wherein the top cap is connected to the central mandrel at a series of outer threads.

9. The pad plunger of claim 1, wherein the top cap comprises:

a top cap base;

a top cap slanted surface connected to the top of the top cap base;

a retrieval neck at the end of the slanted surface;

a retrieval head at the top of the top cap; and a retrieval groove formed between the retrieval neck and the retrieval head.

10. The pad plunger of claim 1, wherein the bottom cap is connected to the central mandrel at a series of outer threads.

11. The pad plunger of claim 1, wherein the bottom cap comprises:

a series of helical bottom cap grooves.

12. The pad plunger of claim 1, wherein the at least one pad assembly comprises:

an upper portion and a lower portion connected by a central ridge;

an upper and a lower protrusion;

an upper and lower protrusion slot in the upper and lower protrusions;

at least one spring groove disposed in the upper and lower portions; and at least one slanted groove disposed in the upper and lower portions.

13. The pad plunger of claim 12, wherein the longitudinal center of the upper portion of the at least one pad assembly is disposed at one longitudinal end of the lower portion of the at least one pad assembly creating an overhang under half of the upper portion and an open space above half of the lower portion.

14. The pad plunger of claim 13, wherein the slanted groove is disposed on a portion of the upper portion with an overhang and on the portion of the lower portion with an open space above.

15. The pad plunger of claim 13, wherein the pad assembly is assembled onto the central mandrel to create a ring with each overhang portion of the upper portion of one pad being placed over the empty space above the lower portion of another pad.

* * * * *